United States Patent [19]

Ellerbrock et al.

[11] 4,016,311

[45] Apr. 5, 1977

[54] METHOD FOR PROTECTING METAL ENDS

[75] Inventors: Donald H. Ellerbrock, Florissant; Robert J. Hough, Baldwin, both of Mo.

[73] Assignee: Boise Cascade Corporation, Boise, Idaho

[22] Filed: May 13, 1974

[21] Appl. No.: 469,524

[52] U.S. Cl. ..... 427/287; 264/135; 264/259; 264/265; 264/294; 264/311; 427/292; 427/388 R; 427/310

[51] Int. Cl.[2] ..... B29C 25/00; B29D 9/08; B29F 5/00

[58] Field of Search ..... 264/134, 270, 294, 296, 264/320, 322, 248, 235, 345, 310, 311, 135, 259, 265; 117/62,64; 220/270, DIG. 3, 54; 427/388 R, 410, 287, 292

[56] References Cited

UNITED STATES PATENTS

| | | | |
|---|---|---|---|
| 732,021 | 9/1969 | Lowe et al. | 117/64 R |
| 3,506,472 | 4/1970 | LaBombarde et al. | 117/64 R |
| 3,510,022 | 5/1970 | Heller | 220/270 |
| 3,696,961 | 10/1972 | Holk | 220/269 |
| 3,754,678 | 8/1973 | Fox et al. | 220/270 |
| 3,765,561 | 10/1973 | Hekal et al. | 220/270 |

OTHER PUBLICATIONS

Skeist, I., Handbook of Adhesives, Reinhold, N.Y. (1962) pp. 6, 447–450.

*Primary Examiner*—Willard E. Hoag
*Attorney, Agent, or Firm*—Lawrence E. Laubscher

[57] ABSTRACT

A protected easy-open metal end for containers is disclosed that contains a scoreline which defines on the central portion of the end a removable panel portion and a residual lip portion. A layer of synthetic resin hot melt material is deposited on one of the central panel surfaces opposite the scoreline, whereupon after the hot melt is solidified, the end is post heated to effect softening of the hot melt so that the metal end surface is wetted thereby. The resultant bond between the hot melt and the metal end is so great that severing of the removable panel from the end effects corresponding severing of the hot melt layer to provide protective hot melt layers on the edges of each of the panel and the residual lip portions. The hot melt layer may be applied to the same or the opposite central panel surface that contains the scoreline, or on both surfaces to provide two-side protection.

5 Claims, 10 Drawing Figures

METHOD FOR PROTECTING METAL ENDS

As evidenced by the Fox et al. U.S. Pat. No. 3,754,678, it has been proposed in the patented prior art to deposit an annular layer of hot melt material on the external surface of a pre-heated easy open end in straddling relation above the scoreline that defines the removable panel in the central portion of the end. The hot melt layer is so designed that upon severing or tearing of the removable panel from the end along the scoreline, the hot melt layer is similarly severed along the scoreline, whereby the edge portions of the upper surfaces of both the removed panel portion and the residual lip portion are covered with a protective hot melt layer.

One drawback of the known hot melt protective measures is that the bond between the hot melt layer and the metal surface of the end is often not sufficiently efficient, whereby the protective hot melt layer, instead of being severed along the scoreline during removal of the panel, is stripped from the external surface of one of the removable panel and residual lip surfaces, whereby an exposed sharp edge is produced that might possibly cause injury to a user's fingers. The present invention was developed to provide an improved process for bonding the hot melt layer to the metal end, which avoids the drawbacks of the prior bonding process and permits the hot melt layer to be deposited opposite the scoreline on either, or both, of the internal and external surfaces of the central portion of the metal end.

Accordingly, a primary object of the present invention is to provide an improved method for applying a protective synthetic resin hot melt layer on the central portion of a metal end opposite and/or above the scoreline that defines the removable panel portion, characterized in that after the hot melt has solidified, the metal end is post heated to soften the hot melt to achieve good wetting of the metal surface, whereby upon resolidification of the hot melt, an efficient bond is achieved.

In accordance with another object of the invention, the metal end is rotated during the initial application of a predetermined quantity of the hot melt, whereby the hot melt layer is in the form of an annular layer arranged coaxially relative to the scoreline on the opposite and/or the same side as the scoreline.

A further object of the invention is to provide a protected metal end including a layer of hot melt applied to the surface of the central portion other than that which contains the removable panel-defining scoreline, said hot melt layer being post heated to effect such a tight bond with the metal surface that during severing of the removable panel portion from the end, the hot melt layer on said other surface is severed and drawn by a "wiping" action around the peripheral faces of the edges of the residual lip and the removable panel, thereby assuring positive protection of the exposed sharp surfaces of the components. If desired, a further hot melt layer may be applied on the opposite surface of the central panel in straddling relation above the scoreline, whereby two-side hot melt protection is achieved.

Other objects and advantages of the invention will become apparent from a study of the specification when viewed in the light of the accompanying drawing, in which:

FIG. 1 is a perspective view of an easy-open container with which the present invention is utilized;

FIGS. *2a* – *2c* are detailed perspective, diametric detail and detail views, respectively, of an easy open end of the prior art;

Figure 1:
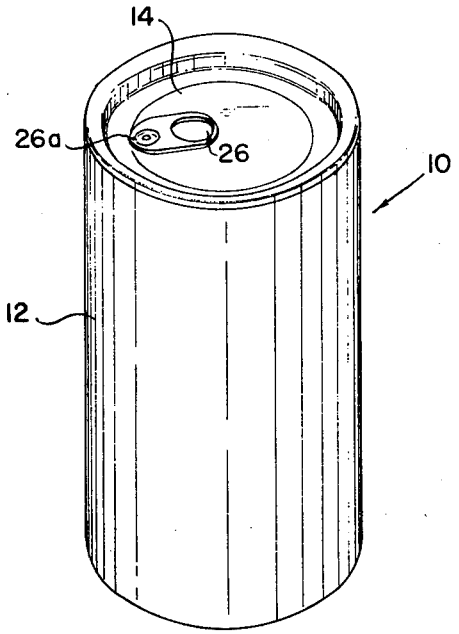
Figure 2A:
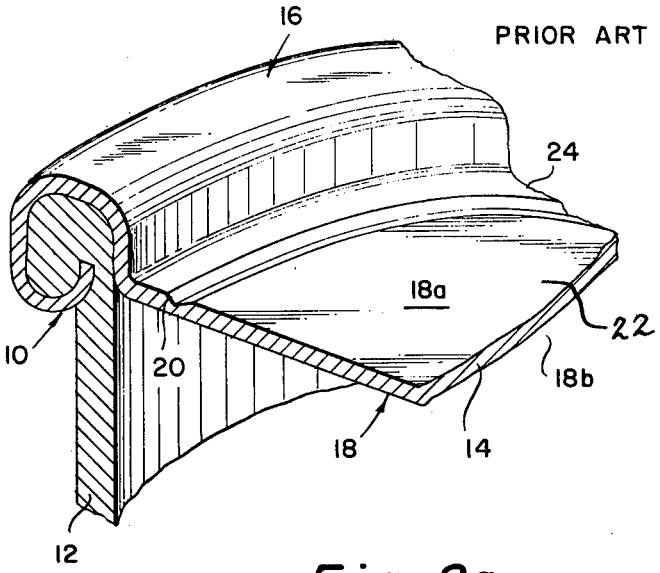
Figure 2B:
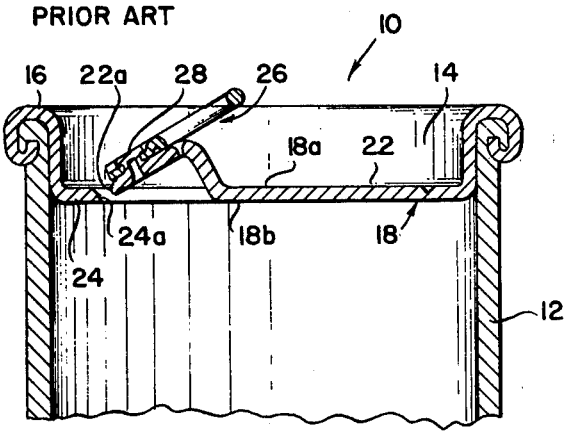
Figure 2C:
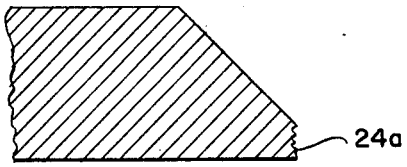

Referring first more particularly to FIGS. 1 and 2, the easy open container 10 includes a body wall 12 (which is formed of metal, paper, a composite metal foil-paper laminate, or the like) and a metal end 14 that is connected with the end of the body wall in a conventional manner (for example, by a rolled seam or press fit connection). The metal end includes a conventional cylindrical flange portion 16 and a central portion 18 the external surface 18a of which contains a circular scoreline 20 which defines a removable panel portion 22 and a residual lip portion 24. A conventional pull tab 26 is connected with the removable panel portion 22 by rivet 28, whereby after the pull tab is pivoted forwardly to cause the nose portion 26*a* thereof to penetrate the scoreline 20, the pull tab is pulled in the opposite direction to effect severing of the removable panel along the scoreline as shown in FIG. 2*b*, thereby leaving the sharp exposed edges 22*a* and 24*a* on the removable panel and on the residual lip portions, respectively, of the metal end.

Figure 3:
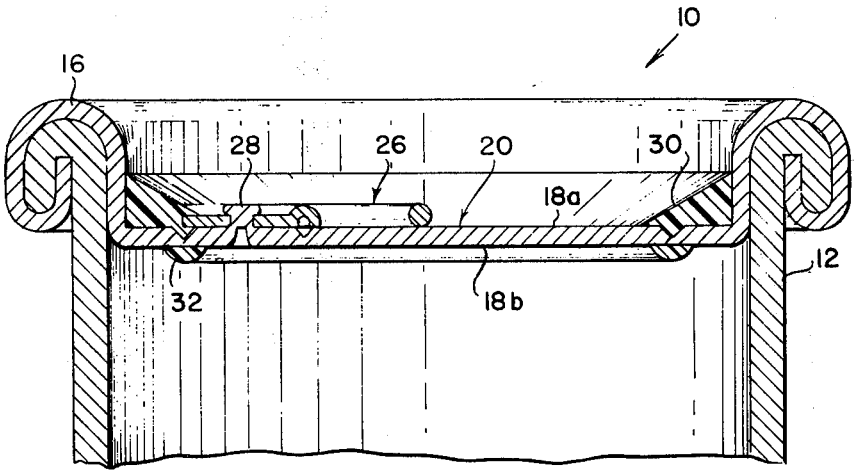
FIG. 3 illustrates in diametric section a two-side hot melt embodiment of the protected easy open end of the present invention.
Figure 4:
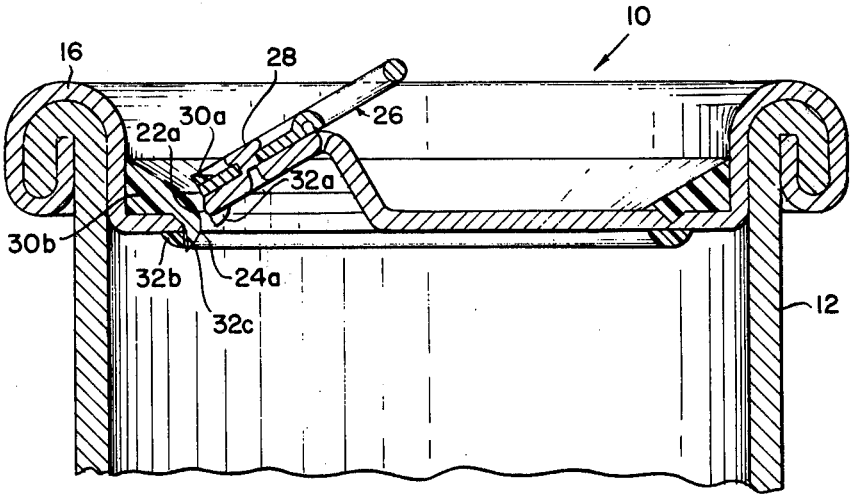
FIGS. 4 and 5 are diametric and detailed sectional views, respectively, of the manner of severing of the hot melt layers during removal of the removable panel from central portion of the end.

Referring now to FIGS. 3 and 4, in accordance with the present invention, annular layers of hot melt 30 and 32 are deposited on the upper and lower surfaces 18*a* and 18*b* of the central portion of the metal end in coaxial arrangement with respect to the scoreline 20. The width of each annular hot melt layer is greater than that of the scoreline 20, whereby the external hot melt layer 30 straddles the scoreline, and the internal hot melt layer extends opposite the scoreline along an area on opposite sides of the scoreline.

Figure 5:
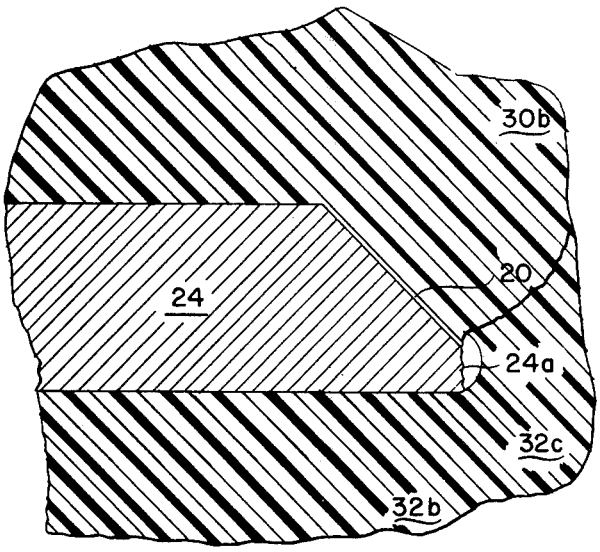
Figure 6:
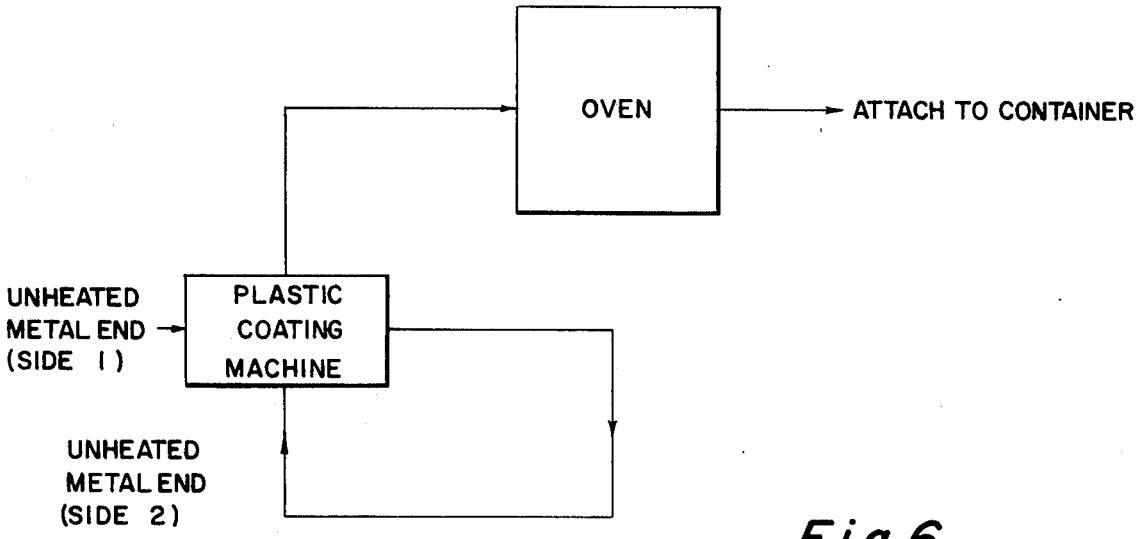
FIG. 6 is a schematic representation of the post heating step that characterizes the present invention.

It is important to note that during the application of each of the hot melt layers in a heated condition to the metal end, the metal end is in an unheated condition and is rotated at a given speed about its axis (while normally being oriented in a vertical plane), whereby the hot melt flows by centrifugal force to an annular configuration coaxial with the scoreline. After both hot melt layers have been applied and have substantially solidified, the metal end is passed through an oven (FIG. 6) to effect softening and reflowing of the hot melt to achieve good wetting of the metal surface by the hot melt, thereby to achieve an unexpectedly tight bond when the metal end leaves the oven and the hot melt resolidifies. Consequently, after the end has been connected with the end of the body wall and the pull tab has been operated to initiate tearing of the removable panel 20 from the metal end as shown in FIG. 4, the hot metal layers are sheared along the scoreline, thereby leaving protective hot melt portions 30*a* and 30*b* on the external surfaces of the edge portions of the removable panel and the residual lip, respectively, and protective hot melt portions 32*a* and 32*b* on the internal surfaces of the edge portions of the removable panel and the residual lip, respectively. Furthermore, owing to the "wiping" effect produced by the shearing of the inner hot melt layer 32, a portion 32*c* thereof (FIG. 5) is drawn in a protective manner around the peripheral surface of the residual lip, thereby substantially completely enclosing the residual lip portion to prevent injury thereby to a user's fingers.

Figure 7:
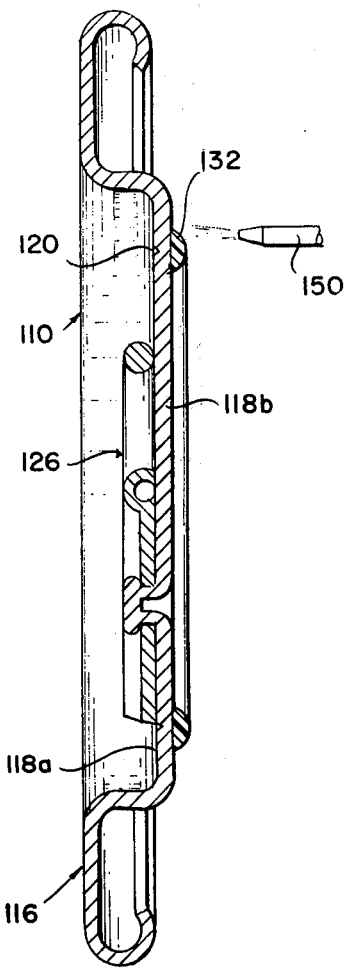
FIG. 7 is a sectional view illustrating the configuration of the annular hot melt layer as centrifugally applied to the internal surface of the metal end.
Figure 8:
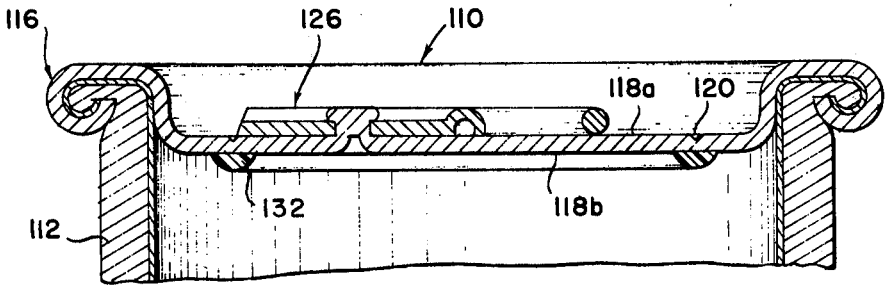
FIG. 8 illustrates the metal end of FIG. 7 after it has been post heated and connected by a rolled seam with the end of a composite container.

Referring now to FIG. 7, an alternate embodiment is illustrated wherein the fluid hot melt 132 (which has an initial temperature of about 300° F.) is applied by means of the nozzle 150 to the internal surface 118*b* of the unheated metal end 110, which hot melt instantaneously commences to solidify as soon as it strikes the surface 118*b*. The end is rotated at such a speed (on the order of 740 rpm) and the quantity of hot melt is so selected (on the order of 50 to 75 mg for a 3-inch end) that the hot melt layer assumes an annular configuration coaxial with the scoreline 120. Following application of the hot melt, the end is passed through an oven in which the end is heated at a temperature of about 250° F. for a period of about 10 seconds, whereupon the hot melt softens and wets the heated metal surface. Consequently, upon cooling of the end, the end is connected to the composite container body 112 as shown in FIG. 8.

The metal ends are formed from materials conventional in the easy-open end art, as for example, a 5052H-19 aluminum alloy coated with an epoxy resin finish. The hot melt is conventional ethylene vinyl acetate H. B. Fuller Company Hot Melt K-4129. The ends are generally of the 3.00 inch, 4.01 inch and 5.02 inch sizes. In the case of a 3.00 inch end treated with the two-side hot melt (FIGS. 3 and 4), the quantity of hot melt applied (at a temperature of about 300° F.) to the external surface 188*a* of the unheated metal end is from about 75 mg to about 100 mg and the speed of rotation of the end is about 870 rpm. Following application of this hot melt layer, a second quantity of hot melt is applied (at a temperature of about 300° F.) to the internal surface 118*b* of the unheated metal end, said second quantity being of from about 50 mg to about 60 mg, and said end being rotated at a speed of about 740 rpm, whereby slinging off of the hot melt is avoided. The end is then passed through an oven where it is heated to a temperature of about 250° F. for about 10 seconds.

It will be apparent that for conventional 4.01 inch and 5.02 inch ends, the quantities of hot melt are proportionally increased and the speeds of rotation are proportionally decreased, respectively. Similar proportions of hot melt and rotational speeds may be adjusted accordingly.

While in accordance with the provisions of the Patent Statutes the best forms and embodiments have been illustrated and described, it will be apparent to those skilled in the art that various modifications may be made without deviating from the inventive concepts set forth herein.

What is claimed is:

1. A method for applying a protective hot melt coating to an easy-open metal end formed of an epoxy-coated aluminum alloy and adapted for closing one end of a container, said metal end having a cylindrical peripheral flange portion and a circular central portion that contains a continuous circular scoreline that defines a removable panel portion and a residual lip portion, said scoreline being formed in the external surface of said central panel portion adjacent said slightly spaced from said flange portion, which comprises the steps of a. simultaneously rotating the metal end, in an unheated condition, about its central axia and applying to at least one of said surfaces of said central portion over at least that area thereof which is coaxially aligned with the scoreline a layer of a thermoplastic ethylene vinyl acetate hot melt material at a temperature of about 300° F., said metal end being rotated about its axis at a speed of rotation which causes the hot melt layer to form an annular configuration in coaxial alignment with said scoreline, said hot melt layer having a width dimension greater than the width of said scoreline;

b. permitting the hot melt material to at least partially solidify;

c. thereafter heating the end at a temperature of about 250° F. for about 10 seconds to effect softening and reflow of the hot melt layer to produce good wetting of the metal end surface; and d. permitting the hot melt material to resolidify, whereby the heating of the hot melt material on said end effects an improved bond with the metal end, so that upon rupture of the scoreline to effect removal of the removable panel portion from the central portion, the hot melt layer ruptures, thereby leaving one part of the hot melt layer on the edge area of the removable panel portion and another part of the hot melt layer on the edge area of the residual lip portion.

2. The method as recited in claim 1, wherein the hot melt layer is applied to the external surface of the center panel in stradling relation above said scoreline.

3. The method as defined in claim 2, wherein the hot melt layer is also applied to the internal surface of the center panel directly opposite said scoreline, thereby affording two-side protection to the edges defined on said removable panel and on said residual lip.

4. The method as defined in claim 3, wherein the quantity of hot melt applied to the internal surface of the metal end is less than the quantity of hot melt applied to the external surface of the metal end.

5. The method as defined in claim 4, wherein the metal end has a diameter of about 3 inches, wherein the quantity of hot melt applied to the external surface of the end is from about 75 mg. to about 100 mg., wherein the speed of rotation of the end during application of the hot melt to the external surface of the end is about 870 rpm, wherein the quantity of hot melt applied to the internal surface of the end is from about 50 mg. to about 60 mg., and wherein the speed of rotation of the metal end during the application of the hot melt to the internal surface thereof is about 740 rpm.

* * * * *